US005083891A

United States Patent [19]

Takahiro

[11] Patent Number: 5,083,891

[45] Date of Patent: Jan. 28, 1992

[54] MULTISTORY PARKING SPACE

[75] Inventor: Tsubota Takahiro, Hyogo, Japan

[73] Assignee: Takenaka Corporation, Osaka, Japan

[21] Appl. No.: 550,999

[22] Filed: Jul. 10, 1990

[30] Foreign Application Priority Data

Jul. 13, 1989 [JP] Japan ..... 1-181281

[51] Int. Cl.[5] ..... E04H 6/20

[52] U.S. Cl. ..... 414/257; 187/52 LC; 414/259; 414/264

[58] Field of Search ..... 414/231, 232, 252, 253, 414/257, 259, 260, 262, 264; 187/52 LC, 56

[56] References Cited

U.S. PATENT DOCUMENTS

| | | | |
|---|---|---|---|
| 1,486,275 | 3/1924 | Becker | 414/257 X |
| 2,899,086 | 8/1959 | De Saint-André | 414/257 X |
| 3,023,212 | 5/1962 | Gaskin et al. | 414/237 |
| 3,279,626 | 10/1966 | De Senigon | 414/231 |
| 3,756,432 | 9/1973 | McCreary | 414/257 X |
| 4,322,804 | 3/1982 | Evans | 414/232 X |
| 4,778,034 | 10/1988 | Marchiari | 187/52 LC |
| 4,778,324 | 10/1988 | Sawyer | 414/232 |
| 4,950,117 | 8/1990 | Go | 414/231 X |

FOREIGN PATENT DOCUMENTS

| | | | |
|---|---|---|---|
| 2324935 | 12/1973 | Fed. Rep. of Germany | 414/257 |
| 1165047 | 10/1958 | France | 414/257 |
| 1178974 | 5/1959 | France | 414/231 |
| 1180339 | 6/1959 | France | 414/257 |
| 63-272867 | 11/1988 | Japan . | |
| 1-150764 | 4/1989 | Japan . | |
| 2-74769 | 3/1990 | Japan . | |
| 2-74770 | 3/1990 | Japan . | |
| 2-108769 | 4/1990 | Japan . | |

*Primary Examiner*—Robert J. Spar
*Assistant Examiner*—Robert S. Katz
*Attorney, Agent, or Firm*—Kerkam, Stowell, Kondracki & Clarke

[57] ABSTRACT

A multistory parking space wherein at least one parking floor is located underground. An entry way and an exit way for vehicles of the multistory parking space are provided with an entrance lift and an exit lift, respectively. The parking floor is provided with at least one power carrier and a large number of parking pallets, and vehicles are transferred between the lifts and the carrier and between the carrier and the pallets by conveyors. Shutters are provided between the lifts and the entry and exit ways, and the lifts and the passenger ways to prevent accidental falling of a vehicle or a passenger.

5 Claims, 6 Drawing Sheets

MULTISTORY PARKING SPACE

FIELD OF APPLICATION

The present invention relates to multistory parking spaces. In particular, the invention relates to a multistory parking space wherein the parking floor or floors are located underground beneath a road or the like.

PRIOR ART

The present inventor proposed a multistory parking space that combines three factors; vertical transport of vehicles by means of lifts, power carriers, and parking pallets (for example, Unexamined Japanese Patent Publication SHO-63-272,867, Unexamined Japanese Patent Publication SHO-63-308,163, and Unexamined Japanese Patent Publication SHO-64-75,308).

The inventor then examined construction of the aforementioned multistory parking space underground beneath a road. In this case, problems to be solved include how to achieve smooth entrance and exit of vehicles into and out of the multistory parking space, and how to prevent accidental falling of a vehicle or a passenger, a requirement resulting from the use of lifts.

Furthermore, it is important to avoid confluence of the entrance flow and the exit flow and handle the entrance and exit operations as smoothly as possible.

SUMMARY OF THE INVENTION

The objects of the present invention are, when a multistory parking space is located underground beneath a road or the like, to assure smooth entrance and exit of vehicles, and to prevent falling accidents in the lifts.

Another object of the present invention is to separate the entrance operations and the exit operations from each other as much as possible so as to assure smooth execution of entrance and exit.

Another object of the present invention is to orient the directions of movement of vehicles on the entry and exit ways and the directions of travel of a power carrier or carriers parallel to the road.

Further object of the present invention is to shorten both entrance and exit time durations of vehicles.

In a multistory parking space according to the present invention, a parking floor or floors are located underground beneath a road, and an entry way and an exit way for vehicles are provided from the road to the multistory parking space, and an entrance lift is provided to front on the entry way, and an exit lift is provided to front on the exit way. When a plurality of entry ways or exit ways are provided, each way is provided with an entrance lift or an exit lift, as appropriate. When an entry or exit way has a plurality of lanes, the numbers of the entry lifts and of the exit lifts must equal the numbers of the corresponding lanes, respectively.

According to the present invention, a parking floor or floors are provided by utilizing the underground portion beneath a road. Naturally, the underground portion of a building fronting on the road may be used. The parking floor or floors are provided with a power carrier or carriers being capable of running on rails and a large number of fixed parking pallets so that the power carrier or carriers are capable of tripping between positions fronting on the lifts and positions fronting on the parking pallets. The lifts, power carrier or carriers, and parking pallets are all provided with vehicle shifting conveyors for transferring vehicles between a lift and a carrier or between a carrier and a parking pallet; thus vehicles are enabled to be shifted between them. A vehicle shutter is provided between the vehicle entry way and the entrance lift, and between the exit way and the exit lift, respectively. A passenger shutter is provided between each lift and the corresponding passenger way. Thus a vehicle is allowed to enter or leave the lift and a passenger is allowed to get in or out of a vehicle in the lift. Each lift is provided with means for verifying that the lift is stationary, abutting on the entry or exit way, and each lift is arranged in such a way that the relevant vehicle shutter and passenger shutter are opened only after the lift has been confirmed to be stationary, abutting on the entry or exit way. For shifting conveyors for vehicles, power rollers, driven belt conveyors, etc. may be used. In the multistory parking space, it is the lifts and the power carrier or carriers that are provided with mechanisms for vertical travelling, running, etc., and the parking pallets are stationary.

The conveyors are preferably arranged to shift the vehicles sideways. In this way, the entry and exit ways running parallel to the road and the power carrier or carriers travelling beneath the road parallel to the road can be interfaced with each other. As a result, both the entry and exit ways and the parking floor or floors are allowed to run parallel to the road.

A waiting zone is desirably provided between the entrance lift and the entry way to stop a vehicle once in the waiting zone and assure the safety of entrance. A gate is desirably provided between the waiting zone and the entry way to prevent rear-end collision against the vehicle standing in the waiting zone.

The lifts are desirably operated to move concurrently with the carrier or carriers so that the travelling time of a lift and that of a carrier overlap with each other to increase the speed of entrance or exit.

The multistory parking space according to the present invention operates as follows. A vehicle moves along the entry way, approaches towards the entrance lift, and stands in front of the lift to wait for the vehicle shutter to open. As the shutter opens only when the lift stands still, abutting on the entry way, the vehicle is prevented from accidental falling. When the lift stands still and the shutter is opened, the vehicle will enter the lift, and the passenger will get out of the lift through the passenger shutter. The passenger shutter opens simultaneously with the vehicle shutter or after the vehicle halts in the lift and the passenger gets out of the vehicle. When the passenger is out of the lift, the lift will descend to a parking floor, and the vehicle will be transferred to a parking pallet via a power carrier. Till exit the vehicle will be parked on the parking pallet.

The operation for exit will be reverse of that for entrance. The vehicle is transferred from the pallet onto a carrier, and then the vehicle is transferred from the carrier onto the exit lift. When the lift stands still, abutting on the exit way, the passenger shutter will be opened. Concurrently with the opening of the passenger shutter or after the passenger has entered into the lift, the vehicle shutter will open to allow the vehicle to exit.

DESCRIPTION OF PREFERRED EMBODIMENT

Figure 1:
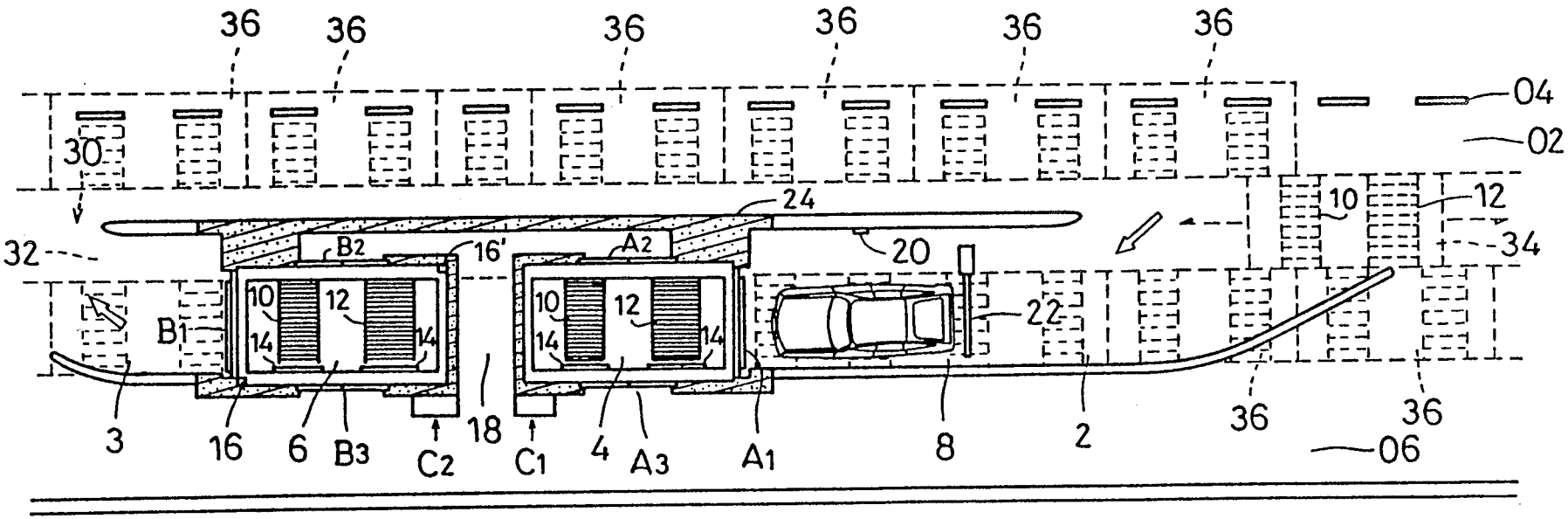
FIG. 1 is a plan view of the ground portion of a multistory parking space according to an embodiment of the present invention.

In FIG. 1, the ground portion of the multistory parking space is indicated by solid lines and an underground parking floor is indicated by broken lines. In the diagram, 02 denotes a roadway, 04 the separator of the lanes, and 06 a sidewalk. 2 denotes the entry way for vehicles, and 3 is the exit way for vehicles, and both ways are provided in the plot of the sidewalk, the frontage road area, etc. 4 denotes an entrance lift, and 6 denotes an exit lift. 8 denotes a waiting zone provided short to the entrance lift 4. The waiting zone 8 may be omitted. Each of the lifts 4 and 6 is provided with a front wheel conveyor 10 and a rear wheel conveyor 12 as conveyors for transferring vehicles. Any types of conveyors such as belt conveyor or power conveyor may be used for the conveyors 10 and 12. In the following explanation, power rollers are assumed to be used. 14 denotes a bumping post provided at the end of a conveyor 10 or 12.

16 denotes a photo detector element for sensing infrared rays, etc., and 16' denotes a light emitting element. Such elements are combined to form a sensor for detecting the presence of a vehicle in the exit lift 6. Although not illustrated herein, it is desirable to provide the entrance lift 4 with a similar sensor for detecting a vehicle. 18 denotes a passenger passageway for passengers to get into or out of the lifts 4 and 6. $A_1$ and $B_1$ denote vehicle shutters, and $A_2$, $A_3$, $B_2$ and $B_3$ denote passenger shutters. As for the shutters $A_2$ and $A_3$ and shutters $B_2$ and $B_3$, one of each pair may be omitted. $C_1$ denotes the control panel for entry, and $C_2$ denotes the control panel for exit. The lifts 4 and 6 always transmit information on their positions to the control panels $C_1$ and $C_2$, respectively.

Element 20 denotes the vehicle detection sensor provided in the waiting zone 8, 22 denotes a gate, and 24 denotes a structural portion of the multistory parking space. The ground portion of the multistory parking space is installed by utilizing the sidewalk area and/or frontage roadway area of the road.

Figure 2:
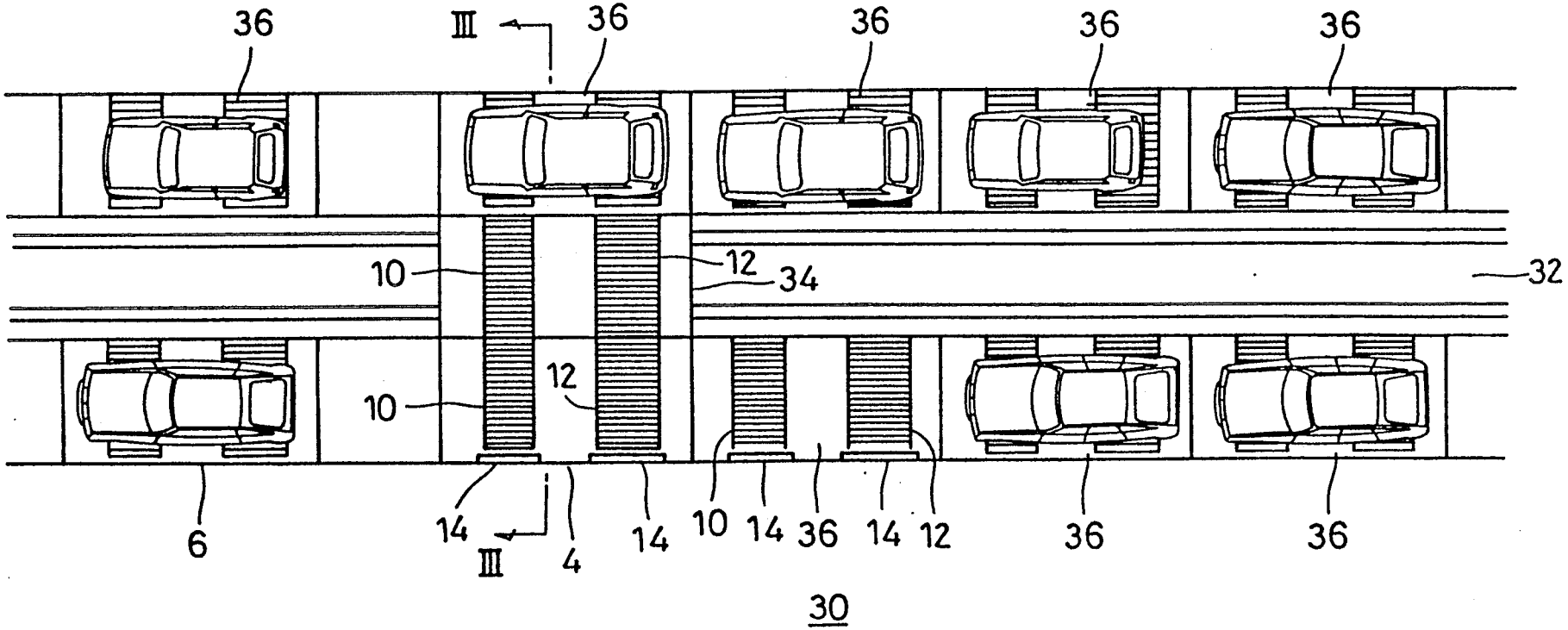
FIG. 2 is a plan view of the underground portion of the same.

The parking floor or floors 30 are provided underground beneath the road. A parking floor 30 is illustrated in FIG. 2. 32 denotes a lane for travelling of the power carrier or carriers 34, and a pair of rails are installed along the lane. A large number of parking pallets 36 are arranged along the lane 32. The power carrier or carriers 34 and the parking pallets 36 are provided with conveyors 10 and 12 similar to those of the lifts 4 and 6. A bumping post 14 is also provided in each pallet 36.

The parking floor 30 may be set at any length. When a long parking floor 30 is used, lifts 4 and 6 are provided at appropriate intervals to prevent congestion of entering and exiting vehicles. In the present case, each parking floor 30 is provided with one motor carrier 34. However, when the parking floor or floors are longer, a plurality of power carriers 34 may be provided. In the embodiment, parking pallets 36 are arranged on both sides of the lane 32 to increase the number of vehicles that can be stored. However, parking pallets 36 may also be arranged on one side only. The parking floor or floors 30 are to be constructed underground beneath the road. It, however, is not necessary to locate the whole space directly beneath the road. A part of the space may be located underground beneath buildings, etc. other than the road.

Figure 3:
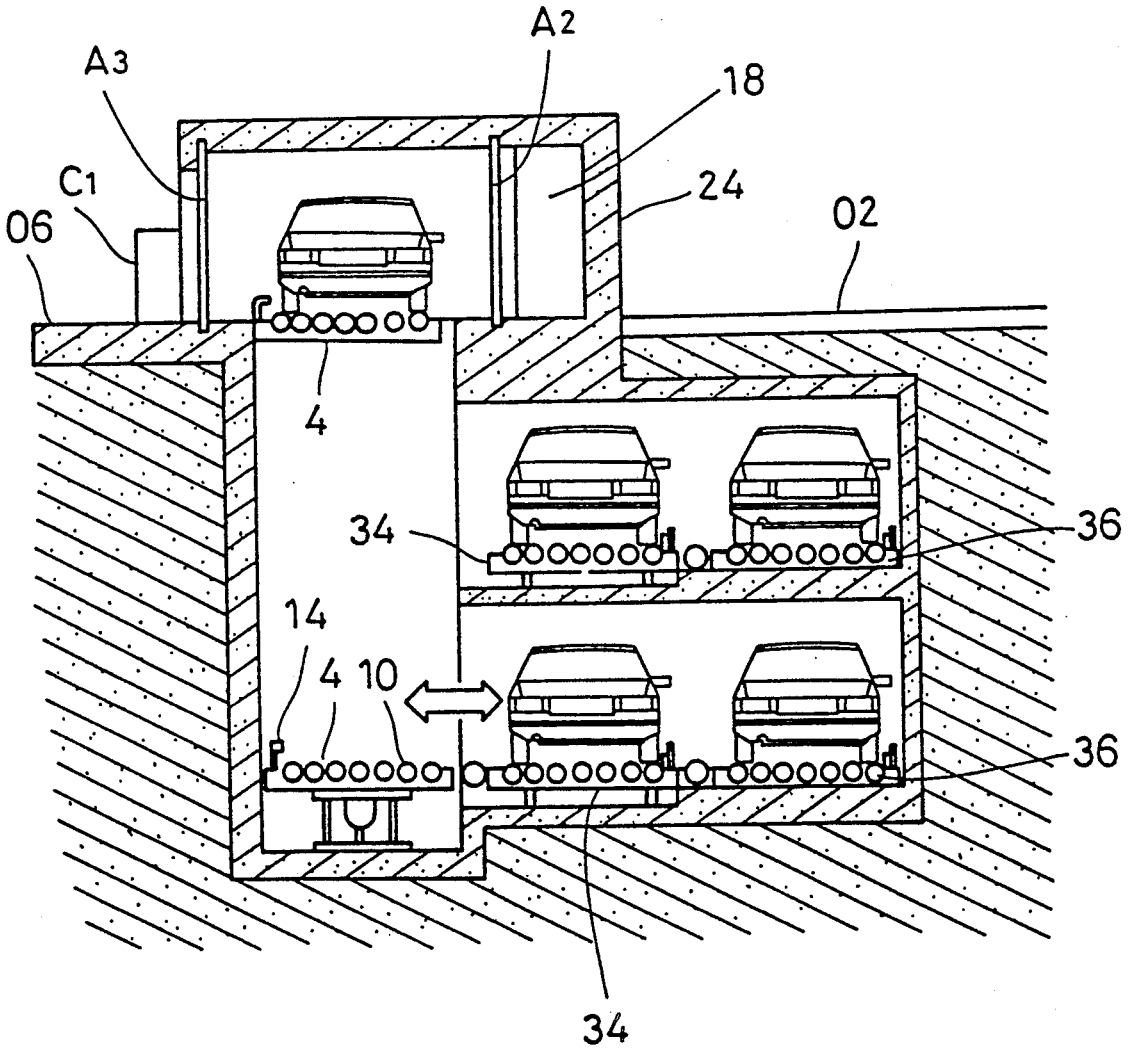
FIG. 3 is a sectional view along the line III—III of FIG. 2.

FIG. 3 shows the multistory parking space in section. Single or more parking floors 30 are provided to front on the underground portions of the lifts 4 and 6. As illustrated, when a plurality of parking floors 30 are provided, it is desirable to shorten the waiting time of the power carrier 34 by allocating, for entrance, a floor 30 for which exit operation is not in progress.

Figure 4:
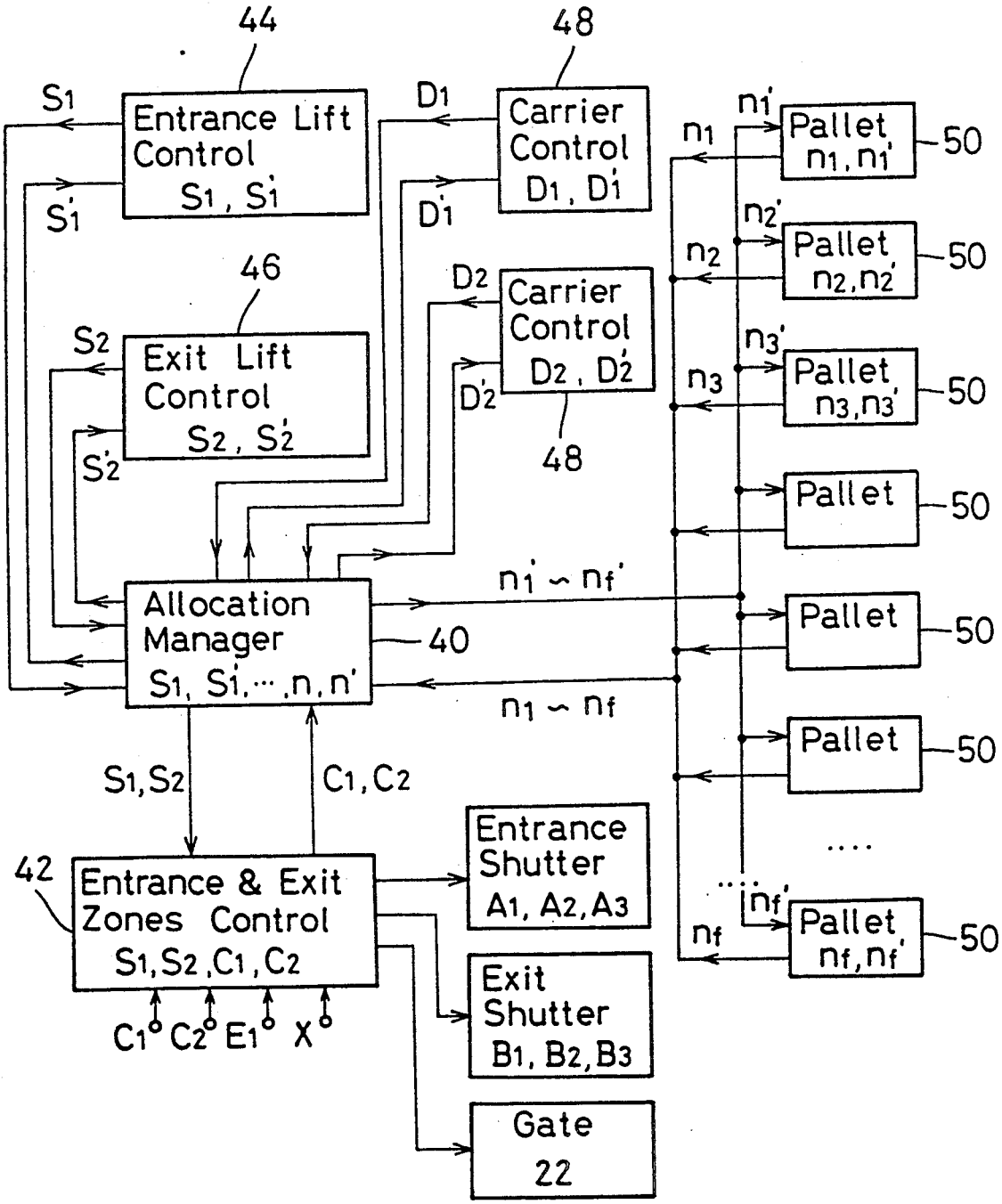
FIG. 4 is a control block diagram of the multistory parking space according to the embodiment.

FIG. 4 shows the control mechanism of the multistory parking space. 40 denotes the main computer for the multistory parking space as a whole. 42 denotes subcomputers for controlling the shutters $A_1$–$B_3$ and the gate 22. 44 and 46 denote subcomputers for controlling the entrance lift 4 and the exit lift 6, respectively. 48 denotes a subcomputer provided for each carrier 34. 50 denotes a subcomputer provided for each parking pallet 36. All communication between subcomputers is effected via the main computer 40, and allocation of parking pallets 36 to vehicles and determination of transport routes between pallets 36 and lifts 4 and 6 are made by the main computer 40. The main computer 40 verifies and synchronizes the signals from the respective subcomputers, and allows operations such as transfer of a vehicle by means of conveyors 10 and 12. The main computer 40 also determines the order of operations when entrance and exit of vehicles are required at the same time.

The respective subcomputers 44–50 receive jobs (symbols marked with ' in the diagrams) from the main computer 40 and send back the states at various time points (symbols without ' in the diagrams) to the main computer 40. $S_1$ and $S_2$ are symbols indicating the states of the lifts 4 and 6; such as the positions and the directions of vertical movement of the lifts 4 and 6, and the states of the conveyors 10 and 12. In a similar manner, the control signals $S_1'$ and $S_2'$ indicate the jobs such as floors to be accessed. The carrier job signals $D_1'$ and $D_2'$ indicate operational jobs such as the next travel target points and the operation of the conveyors 10 and 12 at such points. Next, the job signals $n_1'$–$n_f'$ for the pallets 36 designate any one of the three conditions, entrance, parking and exit, to the respective pallets 36. The pallets 36 report their respective states to the main computer 40 by means of the state signals $n_1$–$n_f$.

$E_1$ in the diagram denotes the signal from the vehicle detection sensor 16, and X denotes the signal from the sensor 20. $C_1$ and $C_2$ denote signals from the control panels $C_1$ and $C_2$, respectively.

Figure 5:
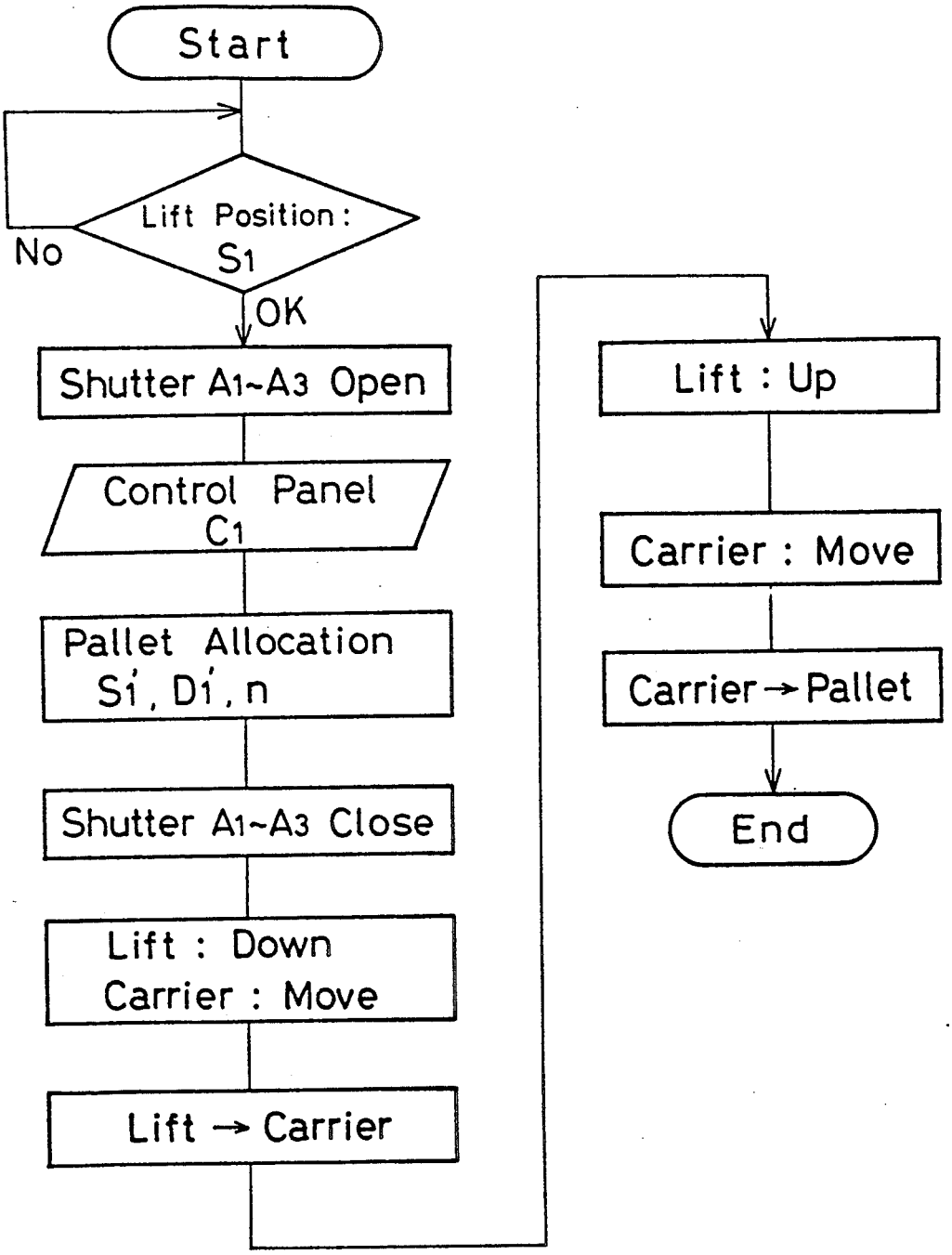
FIG. 5 is an operation flowchart of the embodiment, illustrating the operation during entrance.
Figure 6:
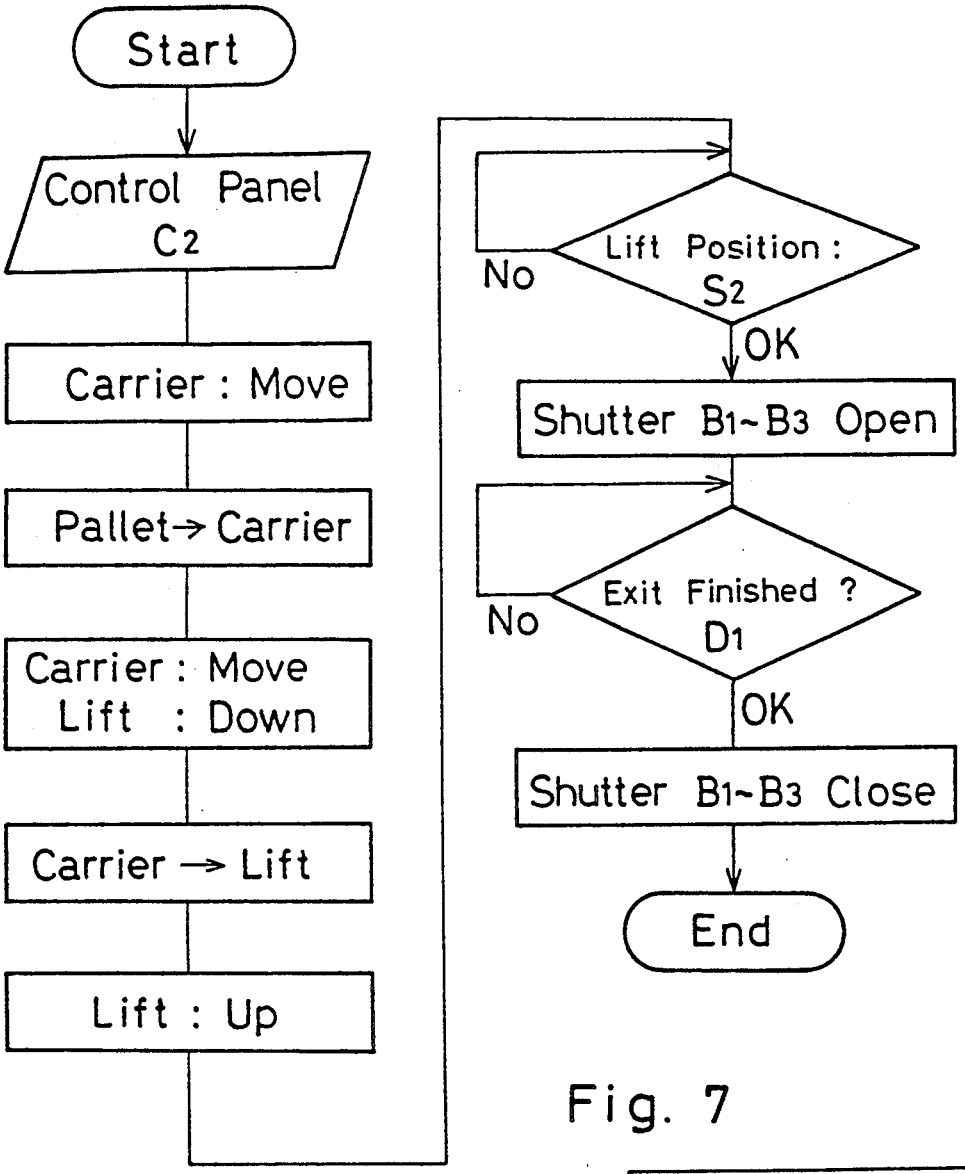
FIG. 6 is an operation flowchart of the embodiment, illustrating the operation during exit.
Figure 7:
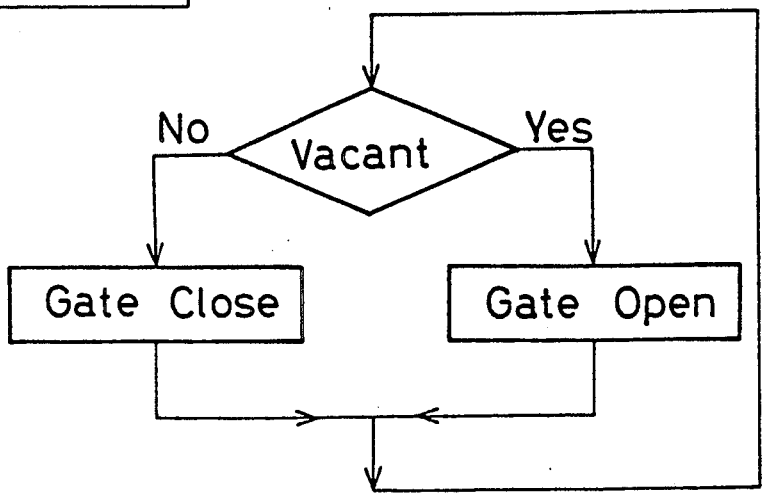
FIG. 7 is an operation flowchart of the embodiment, illustrating the operation of the gate.

FIG. 5 through FIG. 7 indicate the operation flowcharts of the control circuit. In the case of entrance (FIG. 5), the position of the lift 4 is verified by means of the signal $S_1$, and only when the lift 4 is stationary, fronting on the entry way 2, the shutters $A_1$–$A_3$ will be opened. Next, when the passenger gives an input into the control panel $C_1$ to indicate that the entrance operation into the lift 4 is completed, the shutters $A_1$–$A_3$ will be closed, and the main computer 40 will allocate a parking pallet 36 and determine the travel route. Concurrently with the descent of the lift 4 to the parking floor 30, the carrier 34 will move to the position fronting on the lift 4. When both the lift 4 and the carrier 34 are ready, the vehicle will be transferred onto the carrier 34. The transfer of the vehicle is effected by moving the vehicle sideways by means of conveyors 10 and 12. The empty lift 4 will move up to prepare for the next entrance, and the carrier 34 loaded with the vehicle will run to the allocated parking pallet 36, and the vehicle will be transferred onto the pallet 36 by means of conveyors 10 and 12.

In the case of exit (FIG. 6), when a command is given to the control panel $C_2$ by the passenger, the main computer 40 will determine the travelling routes of the carrier 34 and the lift 6, and the carrier 34 will move to receive the vehicle. After the vehicle has been transferred from the pallet 36 onto the carrier 34, the carrier 34 will move to the position fronting on the lift 6. On the other hand, concurrently with this, the lift 6 will move to the floor 30 having the carrier 34, and when both the lift 6 and the carrier 34 are ready, the vehicle will be loaded on to the lift 6. After that, the carrier 34 will start to prepare for carriage of the next vehicle, and the lift 6 will move up to the exit way 3. When the lift 6 arrives, the shutters $B_1$–$B_3$ will be opened, and the passenger will get into the vehicle and drive the vehicle out of the shutter $B_1$. When the completion of exit is verified by the signal $E_1$ from the sensor 16, the shutters $B_1$–$B_3$ will be closed to prevent any person from entering the lift 6.

As illustrated in FIG. 7, the gate 22 is controlled by the signal from the sensor 20, and when the waiting zone 8 is empty, the gate 22 will be opened, and when a vehicle is standing in the waiting zone 8, the gate 22 will be closed.

I claim:

1. A multistory parking space wherein at least one parking floor is located underground, said multistory parking space being characterized in that the multistory parking space is provided with an entry way and an exit way for vehicles, and an entrance lift is provided at the end of the entry way and an exit lift is provided at the beginning of the exit way, the underground parking floor is provided with at least one power carrier for transporting vehicles, said carrier being capable of running on rails, and a large number of fixed parking pallets, said power carrier being arranged so that said power carrier is able to run between positions in front of said lifts and positions in front of parking pallets, and the respective lifts, power carrier, and parking pallets are provided with vehicle shifting conveyors for transferring the vehicles between a lift and a carrier and between a carrier and a pallet, an entrance vehicle shutter is provided between the vehicle entry way and the entrance lift, an exit vehicle shutter is provided between the exit way and the exit lift, and an entrance and exit passenger shutter is provided between each lift and the corresponding passenger way, respectively, and the entrance lift is provided with means for verifying that the entrance lift is stationary and abutting on the entry way, and the exit lift is provided with means for verifying that the exit lift is stationary and abutting on the exit way, so that the entrance vehicle shutter and the entrance passenger shutter of the entrance lift are opened only after the entrance lift has been confirmed to be stationary and abutting on the entry way, and the exit vehicle shutter and the exit passenger shutter of the exit lift are opened only after the exit lift has been confirmed to be stationary and abutting in the exit way.

2. A multistory parking space as described in claim 1, said multistory parking space being further characterized in that the parking floor is located underground beneath a road, and the entry way and the exit way for vehicles are connected to the road.

3. A multistory parking space as described in claim 2, said multistory parking space being further characterized in that the vehicle shifting conveyors are arranged to transfer vehicles to be parked sideways.

4. A multistory parking space as described in claim 3, said multistory parking space being further characterized in that a waiting zone for a vehicle is provided between the entrance lift and the entry way, and a gate is provided between the waiting zone and the entry way, and the gate is arranged to be opened only when the waiting zone is empty.

5. A multistory parking space as described in claim 4, said multistory parking space being further characterized in that the power carrier and lifts are arranged to be moved simultaneously.

* * * * *